US005295873A

United States Patent [19]

Walbrecht

[11] Patent Number: 5,295,873

[45] Date of Patent: Mar. 22, 1994

[54] DOUBLE LEAF SPRING CONTACT WITH STOP DEVICE

[75] Inventor: Wolfram Walbrecht, Wuppertal, Fed. Rep. of Germany

[73] Assignee: Grote & Hartmann GmbH & Co. KG, Fed. Rep. of Germany

[21] Appl. No.: 788,812

[22] Filed: Nov. 7, 1991

[30] Foreign Application Priority Data

Dec. 20, 1990 [DE] Fed. Rep. of Germany ..... 9017229

[51] Int. Cl.[5] ..... H01R 13/00

[52] U.S. Cl. ..... 439/839

[58] Field of Search ..... 439/839

[56] References Cited

U.S. PATENT DOCUMENTS

| | | | |
|---|---|---|---|
| 2,134,074 | 10/1938 | Chirelstein | 439/839 |
| 4,040,713 | 8/1977 | Konneman | 439/839 |
| 4,540,235 | 9/1985 | Lolic | 439/839 |
| 4,583,812 | 4/1986 | Gross, Jr. et al. | 439/839 |

*Primary Examiner*—Joseph H. McGlynn
*Attorney, Agent, or Firm*—Jones & Askew

[57] ABSTRACT

Double leaf spring contact with external enclosure spring and a cover in the form of skids which cover stop devices on fork spring arms of the double-leaf spring contact. Fork spring arms converge in the shape of a curve to form a contact element for a counter contact, and stop devices that protrude towards the outside and maintain a certain distance between the converging fork spring arms are arranged in the contact area. An external enclosure spring includes a box-shaped spring arm base that rests on the spring arm base of the double leaf spring contact in a positive and stationary manner, and converging enclosure spring fork arms are connected to the lateral side walls of the spring arm base that press against the fork spring arms of the double leaf spring contact from the outside. Skids cover at least the stop devices of the fork spring arms of the double leaf spring contact and are arranged on an external enclosure spring that rests on the double-leaf contact spring. The skids prevent the stop devices from hindering insertion of the double-leaf spring contact into a mating plug chamber housing.

14 Claims, 3 Drawing Sheets

DOUBLE LEAF SPRING CONTACT WITH STOP DEVICE

The invention concerns a double leaf spring contact with a stop device.

With double leaf spring contacts currently available on the market, the stop device consists of a latch that is attached to the outer edge of each fork spring arm of a fork spring arm pair and bent in a right angle toward the other fork spring arm pair within a distance from the outer edge, and a web that opposes the corresponding latch and is attached to the outer edge of each fork spring arm of the other fork spring arm pair, in which the web adjoins the free end edge of the angled area of the latch. The outer side of the spacer or stop device is arranged flush with the frontal wall of the spring arm base of the double leaf spring contact.

The double leaf spring contact is inserted into a cuboid-shaped chamber of a plug housing. In this particular instance, the spacer device can hinder the insertion process because the outwardly protruding elements of the spacer device adjoin the frontal edges of the chamber walls in the area of the plug opening of the chamber. Even if the contact area of the double leaf spring contact has been inserted, through tilting of the double leaf spring contact the relatively sharp-edged elements of the spacer device can strike the chamber walls and thus cause increased friction, so that a relatively high coupling force must be applied in order to insert the double leaf spring contact into a housing chamber of a plug housing.

The object of the invention is to create a double leaf spring contact with spacer device, in which the elements of the spacer device do not hinder the insertion of the double leaf spring contact into a housing chamber of a plug housing and thus guarantee a relatively low coupling force.

Figure 1:
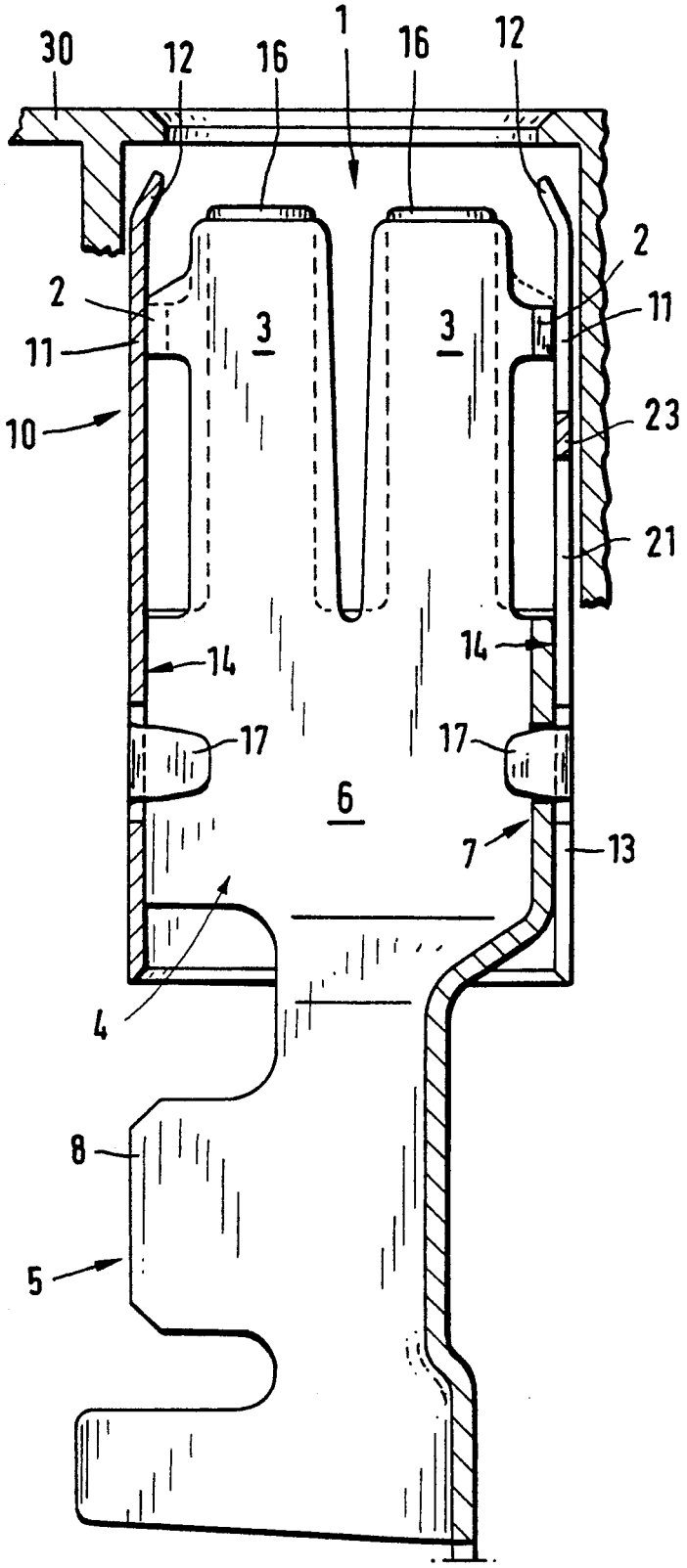
Figure 2:
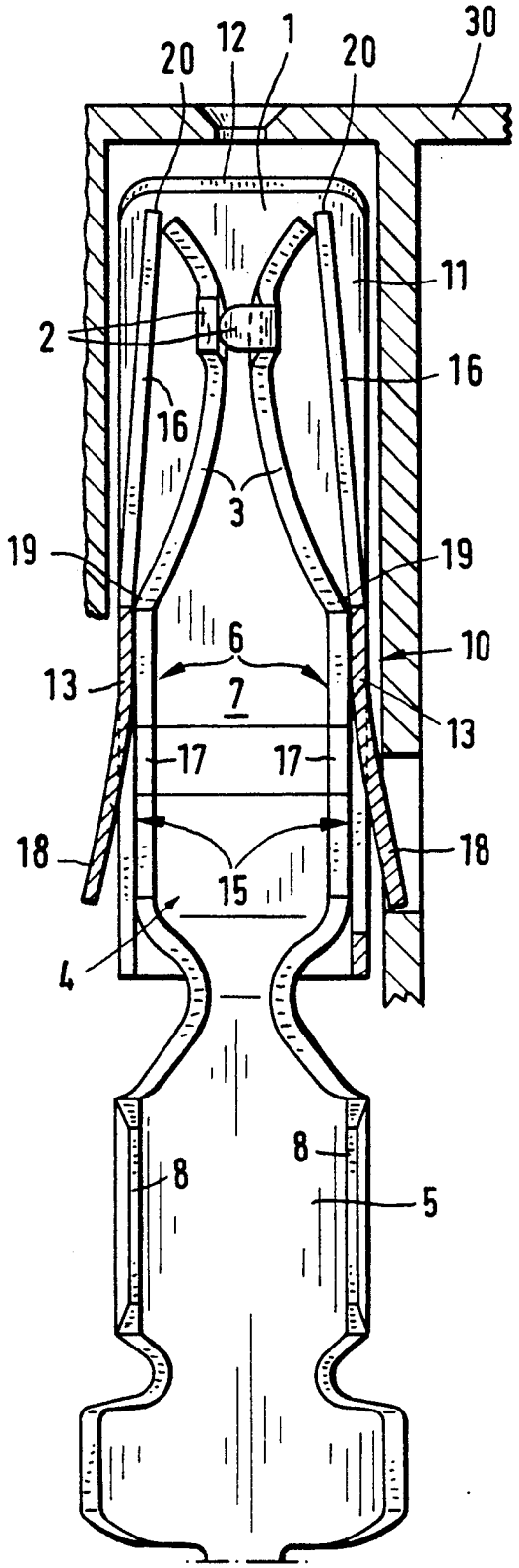
Figure 3:
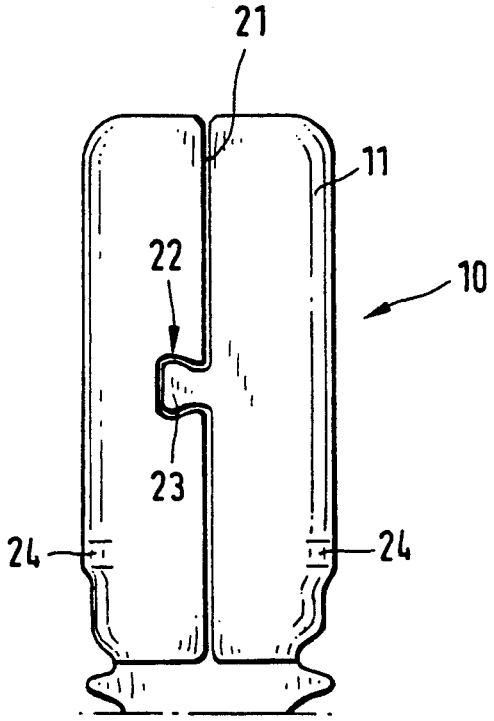

One example of the invention is described in the following with the aid of drawings. They show:

FIG. 1 a longitudinal section through a double leaf spring contact, the frontal walls and the prong base, and through a part of the plug housing chamber;

FIG. 2 a top view of a double leaf spring contact that was inserted into a schematic plug housing chamber (partially sectioned), in which one frontal side wall of the external enclosure spring has been omitted;

FIG. 3 a top view of the seam of a skid of an external enclosure spring.

The double leaf spring contact (1) with external enclosure spring (10) illustrated in FIGS. 1 and 2 is electrical and consists of a punched sheet metal element. The double leaf spring contact (1) consists of one generally U-shaped spring arm base (4) with two lateral side walls (6) and one frontal side wall (7). A prong element with prongs (8) that serves as stop for an electrically conducting wire (not shown) is arranged on one side of the spring arm base (4). Fork spring arms that converge in the shape of a curve are attached to the front edges of the lateral side walls (6) on the other side of the spring arm base (4), in which the fork leaf arms form a contact area for a contact stud of a counter contact (not shown), in the culmination area of the curves. Stop devices (2) that maintain a certain distance between the converging fork leaf arms (3) are arranged in the contact area. The stop devices (2) consist of web or latch-shaped elements.

The external enclosure spring (10) generally consists of a box-shaped spring arm base (13) and several enclosure spring fork arms (16) that connect to the lateral side walls (15). The spring arm base (13) of the external enclosure spring (10) has two lateral side walls (15) and two frontal side walls (14), in which the spring arm base (13) surrounds the spring arm base (4) of the double leaf spring contact (1) from all sides. The desired tight contact of the spring arm base (13) of the external enclosure spring (10) with the spring arm base (4) of the double leaf spring contact (1) is obtained by holding devices in form of latches (17). Two latches (17) each are constructed into the frontal side walls (14) of the external enclosure spring (10), in which the latches are bent towards the inside by approximately 180 degrees so that the spring arm base (13) is solidly connected with the spring arm base (4).

According to the invention, in order to ensure that the insertion of the double leaf spring contact (1) into a chamber of a plug housing (30) is not hindered by the elements of the stop device (2) that serves as spacer and to necessitate only a relatively low coupling force, skids (11) are provided on the frontal side walls (14) of the spring arm base (13) of the external enclosure spring (10) which cover the stop devices (2) from the outside.

One catch spring stud (18) each is punched into the lateral side walls (15) of the spring arm base (13), and these catch spring studs serve as clamping fixtures for the double leaf spring contact (1) in a chamber of plug housing (30) by the fact that they are slightly bent towards the outside, as is illustrated in FIG. 2. The skids (11) connect to the frontal side walls (14) of the spring arm base (13) in direction of the plug housing (30), with one skid (11) each provided per frontal side wall (14). Enclosure spring fork arms (16) connect to the lateral side walls (15), namely two enclosure spring fork arms (16), per lateral side wall (15). The spring arm base (13), as well as the skids (11) and the enclosure spring fork arm (16) are constructed as one piece.

According to the invention, the objective of the skids (11) is to cover the stop devices (2) of the double leaf spring contact (1) in order to prevent entanglement in the chamber of the plug housing (30). This objective is obtained by the fact that the skids (11) extend linearly upward and plane to the spring arm base (13) and tightly adjoin the stop devices (2). In order to obtain an improved insertion of the double leaf spring contact (1), the end areas of the enclosure spring fork arms (11) are bent towards the inside. The bent areas result in slants (12) and thus form a conical taper of the free end of the external enclosure spring (10). This conical taper ensures the simple insertion of the double leaf spring contact (1) into the corresponding chamber of a plug chamber housing (30).

The enclosure spring fork arms (16) are also constructed in a linear manner, but they extend transverse towards the inside in order to adjoin the free ends of the fork spring arms (3). The transverse extension of the enclosure spring fork arms (16) is obtained by the fact that the enclosure spring fork arms (16) are bent in their connecting area to their spring arm base (13). The thus formed angled area (1) can be seen in FIG. 2.

The enclosure spring fork arms (16) are constructed shorter than the skids (11). The termination or the end (20) of the enclosure spring fork arms (16) is located at approximately the same height as the transition of the skids (ii) from their linear to their slanted extension (12). The enclosure spring fork arms (16) that adjoin the fork spring arms (3) of the double leaf spring contact (1) from the outside ensure that the free ends of the fork spring arms (3) cannot gouge into the chamber of the plug housing (30). On the other hand, they increase the necessary tension between the fork spring arms (3) for the reception of a counter contact stud (not shown) because they adjoin the enclosure spring fork arms (16) so tightly.

FIG. 3 shows a top view of a skid (11), in which the spring arm base (13) of the external enclosure spring (10) connecting to the lower end of the skid (11) was omitted. The skid (11) illustrated in the drawing shows a central and continuous butt seam (21) that extends in the longitudinal direction of the skid (11) and, in a corresponding manner, also through the frontal side wall (14) (not shown) of the spring arm base (13). The butt seam (21) is a result of the manufacturing process because the external enclosure spring (10) together with the skids (11) and the enclosure spring fork arms (16) are

I claim:

1. Double leaf spring contact with an external enclosure spring, in which a) the double leaf spring contact is provided with a generally U-shaped spring arm base (4) with lateral side walls (6), and a frontal side wall (7) and prongs (8) for the connection of an electrically conducting wire are connected to one side of the spring arm base, fork spring arms (3) that converge in the shape of a curve are connected to the other side of frontal edges of the lateral side walls, the fork spring arms form a contact stud for a counter contact in a culmination area of the curves, stop devices (2) that protrude toward the outside and maintain a certain distance between the converging fork spring arms are arranged in the contact area, and b) the external enclosure spring (10) is provided with a box-shaped spring arm base (13) that rests on the spring arm base (4) of the double leaf spring contact in a positive and stationary manner, and plural converging enclosure spring fork arms (16) are connected to the lateral side walls (15) of the spring arm base (13) that press against the fork spring arms (3) of the double leaf spring contact from the outside, characterized by the fact that:

c) a cover in form of skids (11) which covers at least the stop devices (2) of the fork spring arms (3) of the double leaf spring contact (1) is disposed on the external enclosure spring (10); and said skids (11) extend linearly upwardly and plane to the spring arm base (13) and tightly adjoin the stop devices (2), so that the elements of the stop devices do not hinder insertion of the double leaf spring contact into a mating plug chamber housing (30).

2. Double leaf spring contact according to claim 1, characterized by the fact that the skids (11) are arranged on frontal side walls (14) of the spring arm base (13) of the external enclosure spring (10).

3. Double leaf spring contact according to claim 1, characterized by the fact that the external enclosure spring (10) has several skids (11), of which at least one covers the opposing stop devices (2).

4. Double leaf spring contact according to claim 1, characterized by the fact that the enclosure spring fork arms (16) of the external enclosure spring (10) are planar.

5. Double leaf spring contact according to claim 1, characterized by the fact that free end areas of the skids (11) are bent toward the inside in the direction of the fork spring arms (3) and thus form a slant (12) operative to simplify the insertion of the double leaf spring contact (1) into the plug chamber housing (30) by a conical taper formed in the end area of the external enclosure spring (10).

6. Double leaf spring contact according to claim 5, characterized by the fact that the skids (11) are arranged in one level with the corresponding frontal side walls (14) of the spring arm bases (13) of the external enclosure spring (10) and are linear up to the slant (12).

7. Double leaf spring contact according to claim 1, characterized by the fact that the enclosure spring fork arms (160 of the external enclosure spring (10) transform into the lateral side walls (15) at an angled area (19) and thus form a transversely inward bent extension towards the double leaf spring contact (1) and provide a conical taper of the external enclosure spring (20).

8. Double leaf spring contact according to claim 7, characterized by the face that the enclosure spring fork arms (16) of the external enclosure spring (10) are constructed shorter than the skids (11), and ends (20) of the enclosure spring fork arms (16) lie at approximately the height of the transformation point of the skids (11) from a linear to a slanted extension (12).

9. Double leaf spring contact according to claim 1, characterized by the fact that the external enclosure spring (10) has holding elements operative to connect the external enclosure spring (10) with the double leaf spring contact (1).

10. Double leaf spring contact according to claim 9, characterized by the fact that the holding element comprises a plurality of latches (17) that are punched out of the spring arm base (13) of the external enclosure spring in the area of frontal side walls (14) and are bent towards the inside by 180 degrees in order to be clamped to the spring arm base (4) of the double leaf spring contact (1).

11. Double leaf spring contact according to claim 1, characterized by the fact that the external enclosure spring (10) is provided with a clamping fixture for the proper fit of the double leaf spring contact (1) in the plug chamber housing (30).

12. Double leaf spring contact according to claim 11, characterized by the fact that the clamping fixture comprises at least one catch spring stud (18) punched out int he area of the spring arm base (13) of the external enclosure spring (10), and the catch spring studs are bent towards the outside and thus create an elastic clamping effect.

13. Double leaf spring contact according to claim 1, characterized by the fact that the external enclosure spring (10) is provided with a continuous butt seam (21) in its longitudinal direction, said seam being arranged in the center of the frontal side walls (14) of the spring arm base (13) and the corresponding skid (11).

14. Double leaf spring contact according to claim 13, characterized by the fact that a dovetail-shaped undercut recess (22) is arranged on an one edge of the butt seam (21) and a correspondingly shaped latch (22) provided in the recess (22) is arranged on the other edge of the butt seam in order to connect or close the butt seam (21) int eh area of the skid (11).

* * * * *

UNITED STATES PATENT AND TRADEMARK OFFICE

CERTIFICATE OF CORRECTION

PATENT NO. : 5,295,873

DATED : March 22, 1994

INVENTOR(S) : WOLFRAM WALBRECHT

It is certified that error appears in the above-indentified patent and that said Letters Patent is hereby corrected as shown below:

Column 4, line 18,"(160" should read --(16) --.

Col. 4, line 24, change "face" to --fact--.

Col. 4, lines 50 and 51, change "int he" to --in the--.

Col. 4, line 67, change "int he" to --in the--.

Signed and Sealed this

Sixth Day of September, 1994

*Attest:*

*Attesting Officer*

BRUCE LEHMAN

*Commissioner of Patents and Trademarks*